US005980271A

United States Patent [19]

MacDougall et al.

[11] Patent Number: 5,980,271

[45] Date of Patent: Nov. 9, 1999

[54] HEADER CONNECTOR OF A FUTURE BUS AND RELATED COMPLIANT PINS

[75] Inventors: Alan MacDougall, West Palm Beach, Fla.; Hsiang-Ping Chen, Taipei Hsiean; Tsung-Hsi Ou Lee, Taipei, both of Taiwan

[73] Assignee: Hon Hai Precision Ind. Co., Ltd., Taipei Hsien, Taiwan

[21] Appl. No.: 09/060,888

[22] Filed: Apr. 15, 1998

[51] Int. Cl.[6] ..... H01R 9/09

[52] U.S. Cl. ..... 439/78; 439/733.1

[58] Field of Search ..... 439/733.1, 78, 439/869

[56] References Cited

U.S. PATENT DOCUMENTS

| | | | |
|---|---|---|---|
| 4,684,190 | 8/1987 | Cark et al. | 439/733.1 |
| 5,286,218 | 2/1994 | Sakurai et al. | 439/733.1 |
| 5,452,512 | 9/1995 | Foley et al. | 439/78 |
| 5,807,142 | 9/1998 | O'Sullivan | 439/733.1 |

*Primary Examiner*—Lincoln Donovan
*Assistant Examiner*—Jean F. Duverne

[57] ABSTRACT

Header connector portion (10) of a future bus connector includes an insulative housing (12) having a bottom wall (14) defining a plurality of passageways (20) therethrough for receiving a corresponding plurality of compliant pins (22) therein and two side walls (16, 18) projecting upward from two opposite sides of the bottom wall (14), respectively. Each pin (22) includes a contact portion (24) for engaging with a complementary contact of a receptacle connector portion of the future bus, a retaining portion (26) having an embossed retention mechanism (29) formed thereon for interferentially engaging with inner walls (17) of the passageways (20) of the housing (12), and a tail portion (30) having an eye (32) of the needle engagement feature for reception in a corresponding hole defined in a PCB. The retention mechanism (29) includes two projections (27, 28), wherein one projection (27) is ramp-shaped and the other projection is either a partial sphere or a partial cylinder (28). The pins (22) are inserted into the passageways (20) so that the projections (27, 28) exert a force perpendicular to a longitudinal direction of the housing (12) on an inner wall (17) of each corresponding passageway (20).

5 Claims, 4 Drawing Sheets

HEADER CONNECTOR OF A FUTURE BUS AND RELATED COMPLIANT PINS

BACKGROUND OF THE INVENTION

1. Field of the Invention

The present invention relates to a future bus electrical connector, and more particularly to a header connector portion of a future bus having compliant pins securely retained therein which do not cause a deformation along a longitudinal direction of the header.

2. The Prior Art

Communication systems commonly consist of a variety of electrical components which transmit and receive information at high speeds. Electrical connectors which facilitate high frequency signal transmission are, thus, required to interconnect the components of the system. A future bus electrical connector, which is effective in applications requiring high frequency signal transmission, is commonly used in communication systems for connecting an electrical card to a printed circuit board.

The future bus consists of a header connector portion electrically connected with and securely mounted on the PCB, and a receptacle connector portion received in the header and electrically engaged therewith. The card is electrically engaged with the receptacle and retained thereto, thus, the card is electrically connected to the PCB by means of the future bus. Such a future bus is disclosed in U.S. Pat. No. 4,975,084.

An insulative housing of the header receives a plurality of compliant pins in passageways defined through a base thereof, respectively. The pins are received in corresponding holes defined in the PCB at one end and engage with conductive contacts of the receptacle at the other end. The pins are retained within the housing by means of a retention mechanism formed on a central portion of each pin for interferential engagement with inner walls of the corresponding passageway. The retention mechanism commonly consists of barbs protruding from opposite sides of each pin, whereby an interference area between the barbs and the inner walls of the corresponding passageways is established along a longitudinal direction of the housing.

However, the interference area is insufficient to securely retain the pins therein. In addition, the force of the barbs acting on the inner walls of each passageway results in a deformation of the housing along the longitudinal direction thereof which alters the pitch of the pins thereby adversely affecting insertion of the pins into holes defined in the PCB due to the discrepancy of pitch therebetween.

Consequently, the pins positioned near lengthwise ends of a housing of extended length are affected by this lengthwise deviation more than others, and may become damaged while being inserted into the corresponding holes of the PCB. Thus, to use a plurality of conventional future bus connectors of reduced length commonly used in succession, may be deemed a possible approach to avoid excessive accumulated deviation of the housing along the lengthwise direction and the associated damage to the pins.

Therefore, an improved header connector and compliant pins for a future bus are required having an improved retention mechanism for retaining the pins within an insulative housing of the header which will not cause an accumulated deformation along a longitudinal direction of the housing.

SUMMARY OF THE INVENTION

An objective of the present invention is to provide an improved header connector portion and compliant pins for a future bus connector having an embossed retention mechanism for retaining the pins within an insulative housing of the header which causes a slight deformation of the housing perpendicular to a longitudinal direction thereof.

Another objective of the present invention is to provide an improved header connector and compliant pins for a future bus having an embossed retention mechanism which provides an increased interference area between protrusions of each pin and an inner wall of a corresponding passageway defined through an insulative housing of the header.

A further objective of the present invention is to provide an improved header connector for a future bus which can securely retain compliant pins in corresponding passageways defined therethrough for proper insertion in corresponding holes of a PCB regardless of the length of the future bus.

Still another objective of the present invention is to provide an improved header connector for a future bus having retention features which allow for repeated insertion and withdrawal of compliant pins without permanently deforming an insulative housing thereof so that the header can be reused without losing any retentive properties.

Still a further objective of the present invention is to provide compliant pins for a header connector of a future bus which are easy to manufacture.

According to one aspect of the present invention, a header connector portion of a future bus connector includes an insulative housing having a bottom wall defining a plurality of passageways therethrough for receiving a corresponding plurality of compliant pins therein and two side walls projecting upward from two opposite sides of the bottom wall, respectively. Each pin includes a contact portion for engaging with a corresponding contact of a receptacle connector portion of the future bus, a retaining portion having an embossed retention mechanism formed thereon for interferentially engaging with an inner wall of a corresponding passageway of the housing, and a tail portion having an eye of the needle engagement feature for reception in a corresponding hole defined in a PCB. The retention mechanism of each retaining portion includes two projections, wherein one projection is ramp-shaped and the other projection is either a partial sphere or a partial cylinder. The pins are inserted into the passageways of the housing so that the projections exert a force perpendicular to a longitudinal direction of the housing on an inner wall of each corresponding passageway.

DETAILED DESCRIPTION OF THE PREFERRED EMBODIMENTS

Figure 1:
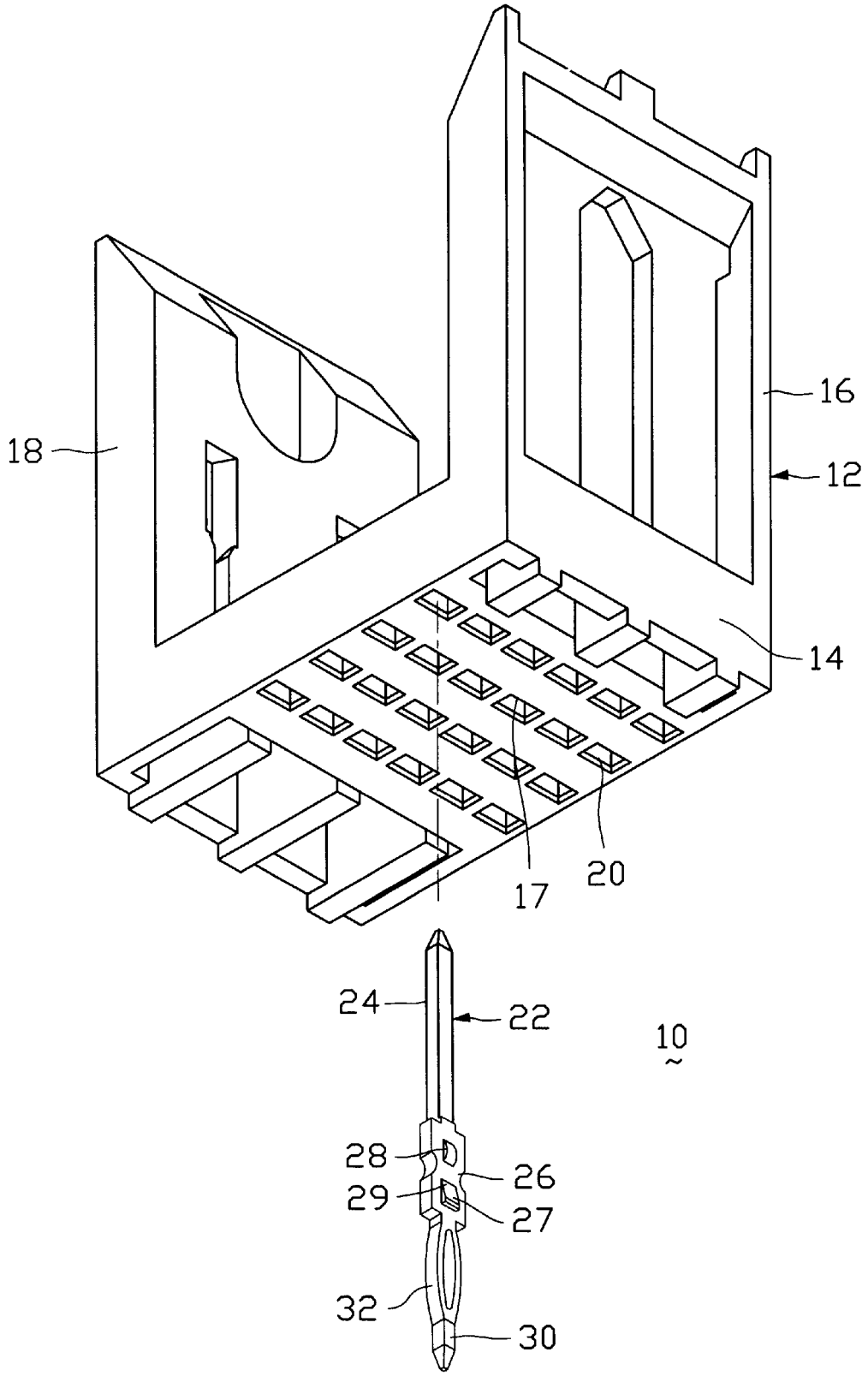
FIG. 1 is an exploded perspective view of a present embodiment of a header connector, according to the invention.
Figure 2:
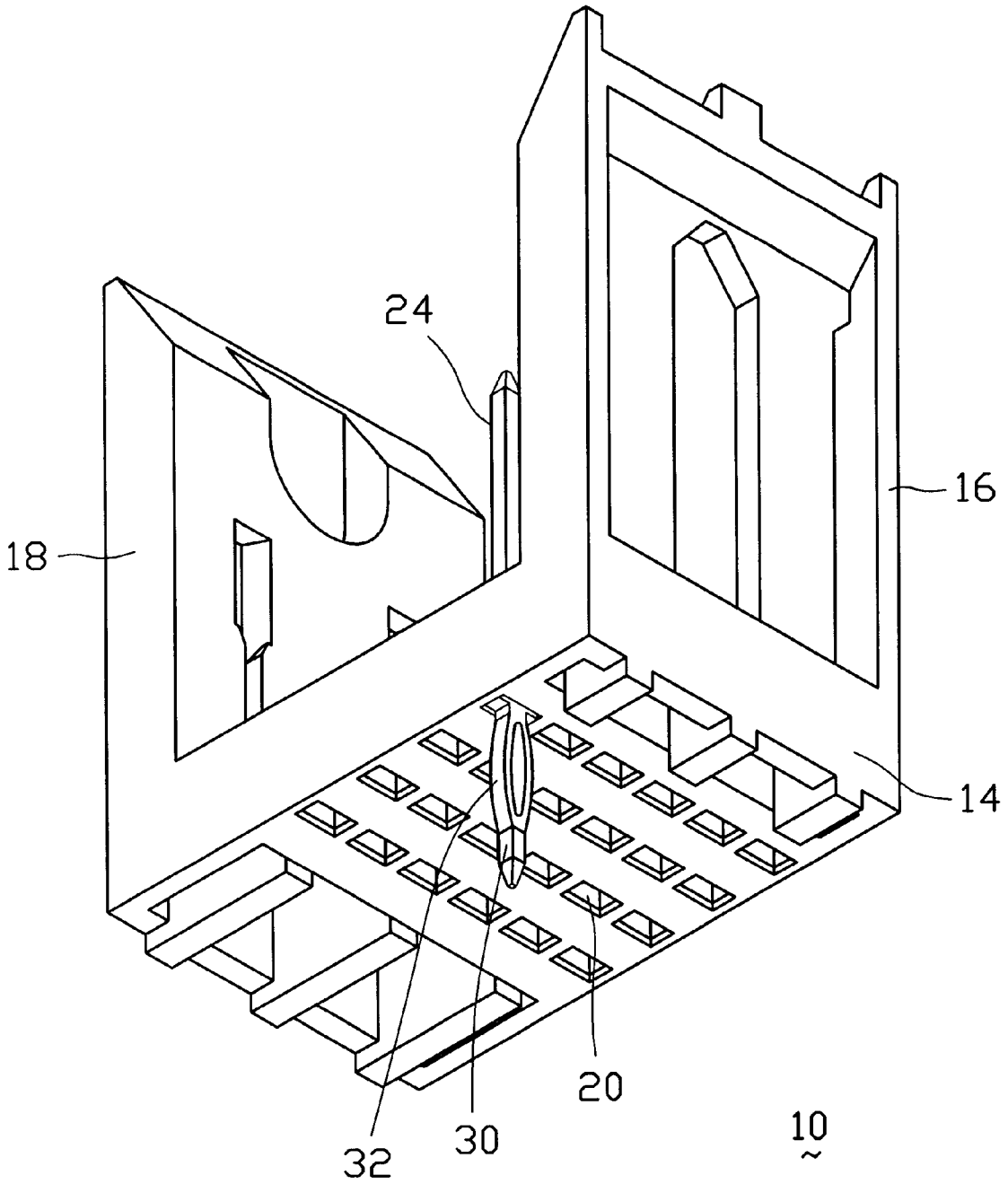
FIG. 2 is a perspective view of the assembled header connector of FIG. 1.
Figure 3:
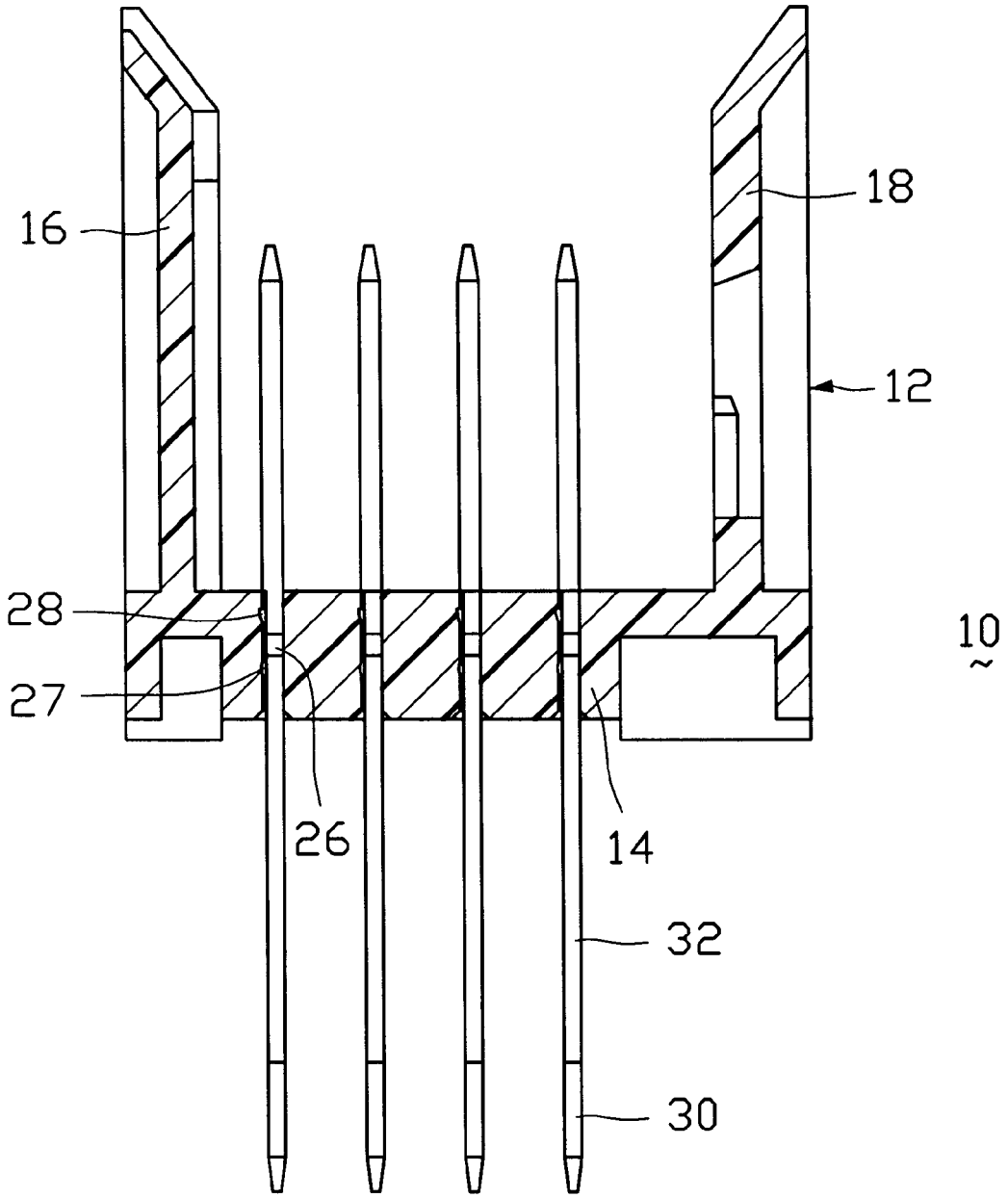
FIG. 3 is a cross sectional view of the assembled header connector of FIG. 1.
Figure 4:
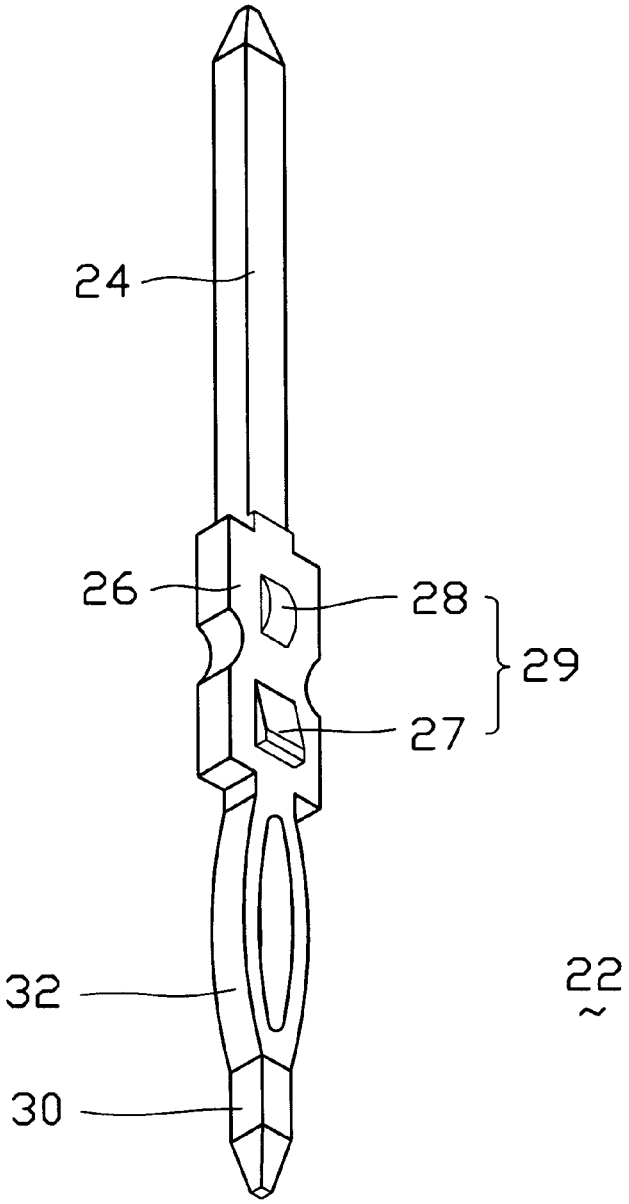
FIG. 4 is a perspective view of the contact of FIG. 1.

Reference will now be made in detail to the preferred embodiments of the present invention.

A header connector portion 10 of a future bus connector includes an insulative housing 12 forming a bottom wall 14, and a first side wall 16 and a second side wall 18 projecting upward from two opposite sides of the bottom wall 16, respectively. A plurality of passageways 20 are defined through the bottom wall 14 for receiving a corresponding plurality of compliant pins or contacts 22 therein, respectively.

Each pin 22, formed by a common stamping operation, includes a contact portion 24 for engaging with a corresponding contact of a receptacle connector portion of the future bus (not shown), a retaining portion 26 having an embossed retention mechanism 29 formed thereon for interferentially engaging with an inner wall 17 of a corresponding passageway 20 of the housing 12, and a tail portion 30 having an eye 32 of the needle engagement feature for reception in a corresponding hole defined in a PCB (not shown).

The retention mechanism 29 of each retaining portion 26 includes two projections 27 & 28, wherein one projection 27 is ramp-shaped and the other projection 28 is either a partial sphere (not shown) or a partial cylinder. The partial sphere projection would provide a larger interference area with the inner wall 17 of a corresponding passageway 20 and would be preferred for applications requiring increased retention of the pins 22 within the housing 12.

The pins 22 are inserted into the passageways 20 so that the projections 27, 28 exert a force perpendicular to a longitudinal direction of the housing 12 on an inner wall 17 of each corresponding passageway 20. Therefore, each pin 22 is securely retained within the housing 12 of the header 10.

The housing 12 shown in the drawing shows twenty-four passageways 20 defined in the bottom wall thereof arranged in six columns and four rows. However, communication systems often require future bus connectors of extended length. Therefore, the header connector 10 of the present invention could easily be extended to accommodate applications requiring elongate connectors, whereby the resulting housing 12 would have multiples of six columns and four rows of passageways defined therethrough.

The above description clearly discloses a header connector portion 10 of a future bus and a plurality of compliant pins 22 received in passageways 20 defined through an insulative housing 12 of the header 10 which do not cause any deformation of the housing 12 along a longitudinal direction thereof. In contrast, the deformation due to the retention mechanism 29 is applied to the lateral direction of the housing 12 and deemed negligible because of only four pins and the corresponding accumulated deviation being involved therewith, thus resulting in no significant deformation occurring thereof.

Moreover, in the invention, the pins 22 are easy to manufacture and can be withdrawn from the housing without causing any permanent deformation thereto, therefore the housing 12 may be reused without losing any retentive properties. In addition, an improved embossed retention mechanism 29 securely retains the pins 22 within the passageways 20 of the housing 12 by increasing the interference area between the retention mechanism 29 and inner walls 17 of the passageways 20.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

We claim:

1. A header connector for use with a future bus connector to receive a receptacle connector portion of said future bus, comprising:

an insulative housing having a bottom wall, and a first side wall and a second side wall projecting upward from two opposite sides of the bottom wall, respectively, said bottom wall having a plurality of passageways defined therethrough, said passageways being aligned in at least one row; and a plurality of compliant pins each having a contact portion for engaging with a corresponding contact of the receptacle of the future bus, a retaining portion having a retention mechanism formed thereon for interferentially engaging with an inner wall of a corresponding passageway of the housing, and a tail portion having an eye of a needle engagement feature for reception in a corresponding hole defined in a PCB, the retention portions of adjacent pins received in the same row of passageways lying in the same plane which is generally coplanar with the associated contact portions, each retention mechanism exerting a retention force on an inner wall of the corresponding passageway, said retention force being perpendicular to a longitudinal direction of the housing and also to the plane in which the retention portions of the pins lie.

2. The header connector as described in claim 1, wherein the retention mechanism comprises a first projection and a second projection.

3. The header connector as described in claim 2, wherein the first projection is ramp-shaped.

4. The header connector as described in claim 2, wherein the second projection is a partial sphere.

5. The header connector as described in claim 2, wherein the second projection is a partial cylinder.

* * * * *